US011116248B2

(12) United States Patent
Reevell

(10) Patent No.: US 11,116,248 B2
(45) Date of Patent: Sep. 14, 2021

(54) ELECTRICALLY OPERATED AEROSOL-GENERATING SYSTEM WITH TUBULAR AEROSOL-GENERATING ARTICLE HAVING IMPROVED AIRFLOW

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 319 days.

(21) Appl. No.: 16/304,884

(22) PCT Filed: May 31, 2017

(86) PCT No.: PCT/EP2017/063234
§ 371 (c)(1),
(2) Date: Nov. 27, 2018

(87) PCT Pub. No.: WO2017/207674
PCT Pub. Date: Dec. 7, 2017

(65) Prior Publication Data

US 2020/0008470 A1 Jan. 9, 2020

(30) Foreign Application Priority Data

May 31, 2016 (EP) ..... 16172325

(51) Int. Cl.
*A24F 47/00* (2020.01)
*A24D 1/20* (2020.01)
(Continued)

(52) U.S. Cl.
CPC ..... *A24D 1/20* (2020.01); *A24F 40/42* (2020.01); *A24F 40/46* (2020.01); *A24F 40/485* (2020.01); *H05B 3/42* (2013.01); *A24F 40/20* (2020.01)

(58) Field of Classification Search
CPC ..... A24F 40/46
See application file for complete search history.

(56) References Cited

U.S. PATENT DOCUMENTS 5,144,962 A 9/1992 Counts et al.
5,498,855 A 3/1996 Deevi et al.
(Continued)

FOREIGN PATENT DOCUMENTS

CN 203194539 U 9/2013
CN 103826481 A 5/2014
(Continued)

OTHER PUBLICATIONS

International Search Report and Written Opinion dated Aug. 11, 2017 in PCT/EP2017/063234 filed May 31, 2017.
(Continued)

*Primary Examiner* — Cynthia Szewczyk
(74) *Attorney, Agent, or Firm* — Oblon, McClelland, Maier & Neustadt, L.L.P.

(57) ABSTRACT

An electrically operated aerosol-generating system is provided, including: a main unit including a heating portion disposed at an outer surface of the main unit, the heating portion including one or more electric heaters; and a tubular aerosol-generating article including a tubular aerosol-forming substrate and an inner passage, wherein the inner passage of the tubular aerosol-generating article is configured to receive the heating portion of the main unit, and the one or more electric heaters are arranged to heat the tubular aerosol-forming substrate when the tubular aerosol-generating article is received on the heating portion of the main unit.

11 Claims, 5 Drawing Sheets

(51) Int. Cl.

| | |
|---|---|
| ***H05B 3/42*** | (2006.01) |
| ***A24F 40/42*** | (2020.01) |
| ***A24F 40/46*** | (2020.01) |
| ***A24F 40/485*** | (2020.01) |
| *A24F 40/20* | (2020.01) |

(56) References Cited

U.S. PATENT DOCUMENTS

| | | | | |
|---|---|---|---|---|
| 5,514,630 | A | 5/1996 | Willkens et al. | |
| 2011/0126848 | A1* | 6/2011 | Zuber | A24F 40/46 131/329 |
| 2014/0360515 | A1* | 12/2014 | Vasiliev | A24F 47/008 131/329 |
| 2015/0059780 | A1* | 3/2015 | Davis | A24F 40/44 131/328 |
| 2015/0090280 | A1 | 4/2015 | Chen | |
| 2017/0119054 | A1 | 5/2017 | Zinovik et al. | |

FOREIGN PATENT DOCUMENTS

| | | | |
|---|---|---|---|
| CN | 103826482 | A | 5/2014 |
| CN | 103960782 | A | 8/2014 |
| CN | 204120238 | U | 1/2015 |
| CN | 104522891 | A | 4/2015 |
| CN | 104544567 | A | 4/2015 |
| CN | 205337592 | U | 6/2016 |
| CN | 205385868 | U | 7/2016 |
| DE | 20 2015 006 397 | U1 | 1/2016 |
| EP | 0 430 559 | A2 | 6/1991 |
| JP | H08-511176 | A | 11/1996 |
| RU | 2 613 785 | C2 | 12/2015 |
| RU | 2 609 395 | C2 | 8/2016 |
| RU | 2015 148 610 | A | 5/2017 |
| WO | WO 03/095688 | A2 | 11/2003 |
| WO | WO 2015/177254 | A1 | 11/2015 |
| WO | 2015/197627 | A1 | 12/2015 |

OTHER PUBLICATIONS

Combined Russian Office Action and Search Report dated Oct. 5, 2020 in Russian Patent Application No. 2018142133 (with English translation), citing documents AO through AS therein, 17 pages.

Combined Chinese Office Action and Search Report dated Dec. 11, 2020 in Patent Application No. 201780029444.X (with English language translation), citing documents AO-AS therein, 15 pages.

Japanese Office Action dated Jun. 28, 2021 in corresponding Japanese Patent Application No. 2018-563002 (with English translation).

* cited by examiner

ELECTRICALLY OPERATED AEROSOL-GENERATING SYSTEM WITH TUBULAR AEROSOL-GENERATING ARTICLE HAVING IMPROVED AIRFLOW

The present invention relates to an electrically operated aerosol-generating system. In particular, the present invention relates to an electrically operated aerosol-generating system comprising a tubular aerosol-generating article and a main unit.

Known handheld electrically operated aerosol-generating systems typically comprise an aerosol-generating device or a main unit comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug. Aerosol-forming substrates, such as tobacco, typically comprise one or more volatile compounds that form an aerosol when heated inside the aerosol-generating device. The heater contained within the aerosol-generating device is inserted into or around the aerosol-forming substrate when the aerosol-generating article is inserted into the aerosol-generating device. In some electrically operated aerosol-generating systems, the aerosol-generating article may comprise a capsule containing an aerosol-forming substrate, such as loose tobacco.

It would be desirable to reduce the size of the existing aerosol-generating systems. It would be desirable to provide an aerosol-generating system that generates an improved aerosol.

According to a first aspect of the present invention, there is provided an electrically operated aerosol-generating system comprising a main unit and a tubular aerosol-generating article. The main unit comprises a heating portion at an outer surface of the main unit. The heating portion comprises one or more electric heaters. The tubular aerosol-generating article comprises: a tubular aerosol-forming substrate; and an inner passage. The inner passage of the tubular aerosol-generating article is configured to receive the heating portion of the main unit. The one or more electric heaters of the main unit are arranged to heat the tubular aerosol-forming substrate when the tubular aerosol-generating article is received on the heating portion of the main unit.

As used herein, the term 'aerosol-generating article' is used to describe an article comprising an aerosol-forming substrate that, when heated, releases volatile compounds that can form an aerosol.

As used herein, the term 'main unit' is used to describe a device that interacts with a tubular aerosol-generating article to generate an aerosol. The main unit typically includes a supply of electrical energy and associated electric circuitry to operate the one or more heating elements. The tubular aerosol-generating article is configured to be received on the main unit.

In particular, the inner passage of the tubular aerosol-generating article is configured to receive the heating portion of the main unit. The tubular aerosol-generating article is generally configured to be removably receivable on the main unit. In other words, the tubular aerosol-generating article is configured to be removable from the main unit without damaging either the tubular aerosol-generating article or the main unit. The tubular aerosol-generating article may be slidably receivable on the main unit. The inner passage of the tubular aerosol-generating article may be configured to slidably receive the heating portion of the main unit.

As used herein, the terms 'inner' and 'outer' refer to relative positions of parts of the tubular aerosol-generating article or the main unit.

As used herein, the term 'inner surface' refers to a surface of an article or a main unit that faces towards the interior of the article or main unit. For example, the inner passage of the tubular aerosol-generating article may be defined by an inner surface. Likewise, the term 'outer surface' refers to a surface of an article or a main unit that faces towards the exterior or outwardly from the system. For example, the heating portion of the main unit is arranged at an outer surface of the main unit. As such, the one or more electric heaters are arranged at the outer surface of the main unit and may be visible to a user when a tubular aerosol-generating article is not received on the heating portion of the main unit. In particular, the heating portion of the main unit is arranged may be arranged at an outer surface of the main unit that is the radially outermost surface of the main unit at that position along the length of the main unit. In other words, the heating portion is generally arranged at a surface of the main unit that is further away from a central longitudinal axis of the main unit than any other part of the main unit at that particular location along the length of the main unit. Hence, the outer surface of the main unit may be visible to a user when a tubular aerosol-generating article is not received on the heating portion of the main unit.

The aerosol-generating system may comprises one or more airflow pathways. In use, a user may draw or puff on the aerosol-generating system to draw air through the one or more airflow pathways of the aerosol-generating system. The main unit may comprises one or more air passages. The main unit may comprise one or more air passages though the heating portion. The one or more air passages of the main unit may form part of the one or more airflow pathways of the aerosol-generating system.

The one or more air passages of the main unit may provide a chamber in which ambient air and vapour from the heated aerosol-forming substrate may mix, cool and form an aerosol. This may improve the aerosol delivered to the user.

The one or more air passages of the main unit may enable the length of the tubular aerosol-generating article to be reduced, as the tubular aerosol-generating article may not be required to provide a space for cooling and mixing of the vapour and air. This may enable the overall length of the aerosol-generating system to be reduced. The main unit may further comprise one or more air inlets. The one or more air inlets may be arranged to enable air to enter the one or more air passages of the main unit. The one or more air inlets may be arranged at the heating portion of the main unit. The one or more air inlets may be arranged such that the one or more air inlets are covered by the tubular aerosol-generating article when the tubular aerosol-generating article is received on the main unit. The one or more air inlets may be arranged to direct vapour from the heated aerosol-forming substrate into the one or more air passages of the main unit.

The heating portion of the main unit may comprise two or more electric heaters spaced over the heating portion. The two or more heaters may be spaced around the circumference of the heating portion. The two or more heaters are spaced along the length of the heating portion. The one or more air inlets may be arranged in the spaces between the two or more electric heaters. This may enable vapour from the heated aerosol-forming substrate to be drawn into the one or more air passages of the main unit, through the one or more air inlets.

The main unit may further comprise one or more air outlets. The one or more air outlets may be arranged to enable air to exit the one or more air passages of the main unit.

The one or more air outlets may be arranged at the proximal end of the main unit.

As used herein, the terms 'proximal' and 'distal' are used to describe the relative positions of components or portions of the aerosol-generating system, aerosol-generating article or main unit of the invention. As used herein, the 'proximal' end of the system is the end on which a user may draw on in use in order to inhale an aerosol generated by the aerosol-generating system. The 'proximal' end may also be referred to as the mouth end. The 'distal' end of the aerosol-generating system is the end opposite to the 'proximal' end. The 'distal' end is the end that is furthest from the user in use.

The one or more air passages of the main unit may extend through the heating portion of the main unit, between the one or more air inlets and the one or more air outlets. The one or more air passages of the main unit may extend through the proximal portion of the main unit. The one or more air passages may extend through the heating portion of the main unit. The one or more air passages of the main unit may extend substantially in the direction of the length of the heating portion of the main unit.

The heating portion of the main unit may be substantially circularly-cylindrical. The heating portion of the main unit may be tubular. The tubular heating portion may comprise an inner passage. The inner passage of the tubular heating portion may be an air passage of the main unit.

The tubular aerosol-generating article may comprise part of the one or more airflow pathways through the system. The tubular aerosol-generating article may comprise one or more air inlets. The one or more air inlets may be configured to enable ambient air to be drawn into the tubular aerosol-generating article. The one or more air inlets may be configured to direct ambient air drawn into the tubular aerosol-forming substrate. The one or more air inlets may be arranged at an outer surface of the tubular aerosol-generating article. Where the tubular aerosol-generating article comprises one or more outer layers circumscribing the tubular aerosol-forming substrate, the one or more air inlets may comprise one or more perforations, holes, slits or any suitable apertures in the one or more outer layers. The one or more air inlets may be arranged at or towards an end of the tubular aerosol-generating article. The one or more air inlets may be arranged at an end face of the tubular aerosol-generating article. The one or more air inlets may be arranged at or towards both ends of the tubular aerosol-generating article.

The system may further comprise a mouthpiece. The mouthpiece may be configured such that when a user draws on the mouthpiece the user draws air through the one or more air passages of the main unit.

In some embodiments, the main unit may comprise the mouthpiece. Where the main unit comprises the mouthpiece, the mouthpiece may comprise the one or more air outlets.

Where the main unit comprises a mouthpiece, when a user draws or puffs on the mouthpiece of the main unit, ambient air may be drawn into the one or more airflow pathways of the aerosol-generating system through the one or more air inlets of the tubular aerosol-generating article. The air may be drawn through the tubular aerosol-forming substrate to the inner surface of the inner passage and into the one or more air passages of the main unit through the one or more air inlets of the main unit arranged at the heating portion. The air may be drawn through the one or more air passages of the main unit to the mouthpiece of the main unit and out of the mouthpiece for inhalation by the user.

In use, when the main unit is switched on, the electric circuitry of the main unit may detect the user drawing on the mouthpiece of the main unit and supply power to one or more of the electric heaters. The one or more powered or activated electric heaters may heat at least a portion of the tubular aerosol-forming substrate of the tubular aerosol-generating article. Volatile components of the heated aerosol-forming substrate may be vapourised and the vapour may be entrained in the air being drawn through the tubular aerosol-forming substrate. The air and vapour may be drawn out of the tubular aerosol-forming substrate at the inner surface of the inner passage and into the one or more air passages of the main unit through the one or more air inlets of the main unit. As the vapour is drawn through the one or more air passages of the main unit, the vapour may cool to form an aerosol. The aerosol may be drawn to the mouthpiece of the main unit and drawn out of the mouthpiece through the one or more air outlets to be delivered to the user for inhalation.

In other embodiments, the tubular aerosol-generating article may comprise the mouthpiece. Where the tubular aerosol-generating article comprises the mouthpiece, the one or more air outlets of the main unit may be directed towards the mouthpiece of the tubular aerosol-generating article when the tubular aerosol-generating article is received on the heating portion of the main unit. The one or more air outlets may be arranged to face the mouthpiece of the aerosol-generating article when the aerosol-generating article is received on the main unit.

Where the tubular aerosol-generating article comprises a mouthpiece, the tubular aerosol-generating article may further comprise a barrier between the aerosol-forming substrate and the mouthpiece. The barrier may be substantially impermeable to gases, such as air and the vapour generated by the heated aerosol-forming substrate. The barrier may substantially inhibit or prevent air and vapour generated by the heated aerosol-forming substrate from being drawn directly through the aerosol-forming substrate and into the mouthpiece, without passing through the one or more air passages of the main unit. This may improve cooling of the vapour generated by the heated aerosol-forming substrate. This may improve the aerosol generated by the aerosol-generating system.

Where the tubular aerosol-generating article comprises a mouthpiece, when a user draws or puffs on the mouthpiece ambient air may be drawn into the one or more airflow pathways of the aerosol-generating system through the one or more air inlets of the tubular aerosol-generating article. The air may be drawn through the tubular aerosol-forming substrate to the inner surface of the inner passage and into the one or more air passages of the main unit through the one or more air inlets of the main unit. The air may be drawn through the one or more air passages of the main unit and out of the main unit through the one or more air outlets. The air may be drawn into the mouthpiece of the tubular aerosol-generating article and out of the mouthpiece to the user for inhalation.

In use, when the main unit is switched on, the electric circuitry of the main unit may detect the user drawing on the mouthpiece of the tubular aerosol-generating article and supply power to one or more of the electric heaters. The one or more powered or activated electric heaters may heat at least a portion of the tubular aerosol-forming substrate of the tubular aerosol-generating article. Volatile components of the heated aerosol-forming substrate may be vapourised and the vapour may be entrained in the air being drawn through the tubular aerosol-forming substrate. The air and vapour may be drawn out of the tubular aerosol-forming substrate at the inner surface of the inner passage and into the one or more air passages of the main unit through the one or more air inlets of the main unit. As the vapour is drawn through the one or more air passages of the main unit, the vapour may cool to form an aerosol. The aerosol may be drawn out of the one or more air passages of the main unit through the one or more air outlets of the main unit into the mouthpiece of the tubular aerosol-forming article and out of the mouthpiece to be delivered to the user for inhalation.

The main unit may comprise one or more additional air inlets. The one or more additional air inlets may be arranged adjacent to the heating portion. As such, the one or more air inlets may not be covered by the tubular aerosol-generating article when the tubular aerosol-generating article is received on the heating portion. The one or more additional inlets may enable ambient air to be drawn directly into the one or more air passages of the main unit. This may facilitate cooling of the vapour drawn into the one or more air passages from the heated aerosol-forming substrate. This may facilitate aerosol formation.

Ambient air may be drawn into the one or more air passages of the main unit through the one or more further air inlets at a relatively fast speed compared to the air and vapour drawn into the one or more air passages through the one or more air inlets arranged at the heating portion and covered by the tubular aerosol-generating article. The relatively fast air from the one or more further air inlets may encouraged air and vapour to be drawn through the one or more air inlets arranged at the heating portion at a faster rate. This may increase the amount of aerosol drawn from the tubular aerosol-generating article and delivered to a user in a puff on the aerosol-generating system. This may improve the experience for the user.

The one or more additional air inlets may be arranged proximal to the heating portion. The one or more additional air inlets may be arranged between the heating portion and the proximal end of the main unit. The one or more additional air inlets may be arranged distal to the heating portion. The one or more additional air inlets may be arranged between the heating portion and the distal end of the main unit. The one or more additional air inlets may be arranged both proximal and distal to the heating portion. The one or more additional air inlets may be arranged at either side of the heating portion.

The aerosol-generating system of the present invention comprises a tubular aerosol-generating article comprising a tubular aerosol-forming substrate. The tubular configuration of the aerosol-generating article and the aerosol-forming substrate may facilitate improved conductive heat transfer from the one or more electric heaters of the main unit to the aerosol-forming substrate. The tubular aerosol-forming substrate may have a larger surface area to volume ratio than a conventional body or a plug of aerosol-forming substrate of equivalent size, without an inner passage. The tubular shape of the aerosol-forming substrate may reduce the maximum thickness of the aerosol-forming substrate. This may facilitate propagation of heat through the aerosol-forming substrate. This may facilitate aerosol generation.

The tubular aerosol-generating article may be any suitable shape and size. The tubular aerosol-generating article may be substantially cylindrical. The tubular aerosol-generating article may be substantially elongate. The tubular aerosol-generating article may comprise a cylindrical open-ended hollow tube of aerosol-forming substrate. The tubular aerosol-generating article may have any suitable cross-section. For example, the cross-section of the tubular aerosol-generating article may be substantially circular, cylindrical, square or rectangular.

The tubular aerosol-generating article may have a width of between about 5 mm and about 20 mm, between about 5 mm and about 12 mm or about 8 mm.

The tubular aerosol-generating article may have a length of between about 10 mm and about 100 mm, or between about 10 mm and about 50 mm, between about 30 mm and about 60 mm or about 45 mm.

The length of the tubular aerosol-generating article may be substantially similar to the length of the heating portion of the main unit. The length of the tubular aerosol-generating article may be equal to or greater than the length of the heating portion of the main unit such that tubular aerosol-generating article covers the one or more electric heaters when the tubular aerosol-generating article is received on the heating portion of the main unit.

As used herein, the term 'width' is used to describe the maximum dimension in the transverse direction of the aerosol-generating system, the tubular aerosol-generating article and the main unit. When used herein, the term 'length' is used to describe the maximum dimension in the longitudinal direction of the aerosol-generating system, the tubular aerosol-generating article and the main unit.

As used herein, the term 'longitudinal' is used to describe the direction between the proximal or mouth end and the distal end of the aerosol-generating system and the term 'transverse' is used to describe the direction perpendicular to the longitudinal direction.

The tubular aerosol-generating article comprises an inner passage. As used herein, the term 'inner passage' refers to a passage extending through at least part of the article. The inner passage may be surrounded by an annular body and may extend substantially along a longitudinal axis of the article.

The inner passage of the tubular aerosol-generating article may be any suitable shape and may have any suitable cross-section. For example, the cross-section of the inner passage may be substantially circular, cylindrical, square or rectangular. The inner passage may be arranged substantially centrally in the tubular aerosol-generating article. As such, the thickness of the tubular aerosol-forming substrate may be substantially consistent around the circumference of the tubular aerosol-generating article. This may enable even heating of the tubular aerosol-forming substrate about the circumference of the tubular aerosol-generating article.

The inner passage may have a width of between about 2 mm and about 18 mm, between about 2 mm and about 10 mm or about 4 mm.

The width of the inner passage of the tubular aerosol-generating article may be substantially similar to the width of the heating portion of the main unit. As such, the inner surface of the inner passage may contact or abut the outer surface of the heating portion of the main unit when the tubular aerosol-generating article is received on the heating portion. The width of the inner passage of the tubular aerosol-generating article may be smaller than the width of the heating portion of the main unit, such that the tubular aerosol-generating article is received on the heating portion with a friction or an interference fit.

The tubular aerosol-forming substrate may be a solid aerosol-forming substrate. The tubular aerosol-forming substrate may be a solid aerosol-forming substrate at room temperature. The tubular aerosol-forming substrate may comprise a tobacco-containing material containing volatile tobacco flavour compounds which are released from the substrate upon heating. The tubular aerosol-forming substrate may comprise a non-tobacco material. The tubular aerosol-forming substrate may comprise tobacco-containing material and non-tobacco containing material.

The solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

The solid aerosol-forming substrate may contain tobacco or non-tobacco volatile flavour compounds, which are released upon heating of the solid aerosol-forming substrate.

The solid aerosol-forming substrate may be provided on or embedded in a thermally stable carrier. The carrier may take the form of powder, granules, pellets, shreds, strands, strips or sheets. The solid aerosol-forming substrate may be deposited on the entire surface of the carrier. The solid aerosol-forming substrate may be deposited in a pattern to provide a non-uniform flavour delivery during use.

The tubular aerosol-forming substrate may comprise a gathered textured sheet of homogenised tobacco material. The tubular aerosol-forming substrate may comprise a gathered textured sheet of homogenised tobacco material comprising one or more of a plurality of spaced-apart indentations, protrusions and perforations. Use of a textured sheet of homogenised tobacco material may facilitate gathering of the sheet of homogenised tobacco material to form the tubular aerosol-forming substrate.

As used herein, the term 'sheet' refers to a laminar element having a width and length substantially greater than a thickness. As used herein, the term 'gathered' is used to describe a sheet that is convoluted, folded, or otherwise compressed or constricted substantially transversely to a longitudinal axis of the tubular aerosol-generating article. As used herein, the term 'textured sheet' denotes a sheet that has been crimped, embossed, debossed, perforated or otherwise deformed. As used herein, the term 'homogenised tobacco material' refers to a material formed by agglomerating particulate tobacco.

The tubular aerosol-forming substrate may comprises a gathered crimped sheet of homogenised tobacco material. As used herein, the term 'crimped sheet' refers to a sheet having a plurality of substantially parallel ridges or corrugations. Preferably, the substantially parallel ridges or corrugations extend along or parallel to a longitudinal axis of the tubular aerosol-generating article. This may facilitate gathering of the crimped sheet of homogenised tobacco material to form the tubular aerosol-generating article. However, it will be appreciated that crimped sheets of homogenised tobacco material for inclusion in the tubular aerosol-generating article may alternatively or in addition have a plurality of substantially parallel ridges or corrugations that are disposed at an acute or obtuse angle to the longitudinal axis of the tubular aerosol-generating article.

The tubular aerosol-forming substrate may comprise one or more aerosol formers. The tubular aerosol-forming substrate may comprise a single aerosol former. The tubular aerosol-forming substrate may comprise two or more aerosol formers. The tubular aerosol-forming substrate may have an aerosol former content of greater than about 5 percent on a dry weight basis. The aerosol aerosol-forming substrate may have an aerosol former content of between about 5 percent and approximately 30 percent on a dry weight basis. The tubular aerosol-forming substrate may have an aerosol former content of about 20 percent on a dry weight basis.

As used herein, the term 'aerosol former' refers to any suitable known compound or mixture of compounds that, in use, facilitates formation of an aerosol and that is substantially resistant to thermal degradation at the operating temperature of the tubular aerosol-generating article. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The tubular aerosol-generating article may comprise one or more layers circumscribing the tubular aerosol-forming substrate. For example, the tubular aerosol-generating article may comprise one or more wrappers wrapped around the tubular aerosol-forming substrate.

The one or more layers may comprise a thermally insulating material. Wrapping a layer of thermally insulating material around the tubular aerosol-forming substrate may facilitate retention of heat from the one or more electric in the tubular aerosol-generating article. This may improve the conductive heat-transfer efficiency of the aerosol-generating system. As used herein the term 'thermally insulating material' is used to describe material having a bulk thermal conductivity of less than about 50 milliwatts per metre Kelvin (mW/(m·K)) at 23° C. and a relative humidity of 50% as measured using the modified transient plane source (MTPS) method. The thermally insulating material may also have a bulk thermal diffusivity of less than or equal to about 0.01 square centimetres per second (cm2/s) as measured using the laser flash method.

The one or more layers may comprise a material that is substantially impermeable to gases, such as air. Circumscribing the tubular aerosol-forming substrate with a layer of material that is substantially impermeable to gas may facilitate retention of vapour generated by the tubular aerosol-generating article in the aerosol-generating system and may facilitate direction of the vapour towards the user.

The one or more layers may comprise any suitable material. The one or more layers may comprise a paper-like material. The one or more layers may comprise cigarette paper. The one or more layers may comprise tipping paper.

The inner passage of the tubular aerosol-forming substrate may be the inner passage of the tubular aerosol-generating article. As such, the one or more electric heaters of the main unit may be adjacent to or in contact with the tubular aerosol-forming substrate when the tubular aerosol-generating article is received on the heating portion of the main unit. However, in some embodiments, the tubular aerosol-generating article may comprise one or more layers circumscribing the inner surface of the inner passage of the tubular aerosol-forming substrate. The one or more inner layers may comprise substantially the same material as described above in relation to the one or more outer layers.

At least one end of the inner passage of the tubular aerosol-generating article may be open and configured to receive the heating portion of the main unit. The inner passage of the tubular aerosol-generating article may comprises two open ends configured to receive the heating portion of the main unit.

The tubular aerosol-generating article may comprise additional components.

The tubular aerosol-generating article may comprise a mouthpiece. The mouthpiece may be arranged at the proximal end of the tubular aerosol-generating article. Where the tubular aerosol-generating article comprises a mouthpiece, the tubular aerosol-generating article may comprise a proximal end comprising the mouthpiece and a distal end comprising an open end of the inner passage configured to receive the heating portion of the main unit.

The mouthpiece may be a single segment or component mouthpiece. The mouthpiece may be a multi-segment or multi-component mouthpiece. The mouthpiece may comprise a material of low or very low filtration efficiency. The mouthpiece may comprise a filter comprising one or more segments comprising any suitable filtration materials. Suitable filtration materials are known in the art and include, but are not limited to, cellulose acetate and paper. The mouthpiece may comprise one or more segments comprising absorbents, adsorbents, flavourants, and other aerosol modifiers and additives or combinations thereof. The mouthpiece may have a width that is substantially equal to the width of the tubular aerosol-generating article.

Where the tubular aerosol-generating article comprises a mouthpiece, the tubular aerosol-generating article may be configured such that the main unit terminates inside the tubular aerosol-generating article. The proximal end of the main unit may abut or contact the mouthpiece when the tubular aerosol-generating article is received on the heating portion of the main unit. The proximal end of the main unit may be spaced from the mouthpiece when the tubular aerosol-generating article is received on the heating portion of the main unit.

The tubular aerosol-generating article may comprise additional components, including at least one of an aerosol-cooling element and a transfer element arranged between the tubular aerosol-forming substrate and the mouthpiece.

The tubular aerosol-generating article may comprise a cooling element arranged between the tubular aerosol-forming substrate and the mouthpiece. The cooling element may comprise a plurality of longitudinally extending channels. The cooling element may comprise a gathered sheet of material selected from the group consisting of metallic foil, polymeric material, and substantially non-porous paper or cardboard.

The tubular aerosol-generating article may comprise a transfer element or spacer element arranged between the tubular aerosol-forming substrate and the mouthpiece. The transfer element may facilitate cooling of the aerosol generated by the heated the tubular aerosol-forming substrate. The transfer element may also facilitate adjustment of the length of the aerosol-generating system to a desired value, for example to a length similar to that of a conventional cigarette. The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Where the tubular aerosol-generating article comprises one or more layers or wrappers circumscribing the tubular aerosol-forming substrate, the one or more layers or wrappers may also circumscribe any of the additional components, such as the mouthpiece, the cooling element and the transfer element.

According to a second aspect of the present invention, there is provided a tubular aerosol-generating article for an electrically operated aerosol-generating system according to the first aspect of the present invention. The tubular aerosol-generating article comprises: a tubular aerosol-forming substrate; an inner passage configured to receive the heating portion of the main unit; a mouthpiece; and a substantially air impermeable barrier arranged between the tubular aerosol-forming substrate and the mouthpiece.

The aerosol-generating system of the present invention also comprises a main unit. The main unit may comprise a housing. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material may be light and non-brittle. The main unit may comprise a proximal portion and a distal portion. The proximal portion and the distal portion of the main unit may have different shapes and dimensions.

The proximal portion of the main unit may comprise the heating portion at the outer surface. As used herein, the term 'heating portion' is used to describe the portion of the main unit that comprises the one or more electric heaters. The extent of the heating portion is determined by the extent of the heaters over the outer surface of the main unit.

The heating portion may have any suitable shape and dimensions. The shape and dimensions of the heating portion may be substantially similar to the shape and dimensions of the inner passage of the tubular aerosol-generating article. The shape and dimensions of the heating portion may be complementary to the shape of the inner passage of the tubular aerosol-generating article.

The heating portion may be substantially cylindrical. The heating portion may be substantially elongate. The heating portion may have any suitable cross-section. For example, the cross-section of the heating portion may be substantially circular, elliptical, square or rectangular. The shape of the heating portion may be substantially similar to the shape of the inner passage of the tubular aerosol-generating article. The shape of the heating portion may be complementary to the shape of the inner passage of the tubular aerosol-generating article.

Where the cross-sections of the heating portion and the tubular aerosol-generating article are not circularly symmetrical, the tubular aerosol-generating article may be received on the heating portion at specific rotational orientations. Where the cross-sections of the heating portion and the tubular aerosol-generating article are circularly symmetrical, this may eliminate the need to maintain a specific rotational orientation of the tubular aerosol-generating article for the tubular aerosol-generating article to be received by the heating portion.

The heating portion may have a width of between about 2 mm and about 18 mm, between about 2 mm and about 10 mm or about 4 mm. The heating portion may have a length of between about 10 mm and about 100 mm, or between about 10 mm and about 50 mm or about 45 mm.

The main unit may comprise any suitable number of electric heaters. The main unit may comprise one electric heater. The main unit may comprise two or more electric heaters. The main unit may comprise two, three, four, five, six, seven, eight or nine electric heaters. Where the main unit comprises two or more electric heaters, the two or more electric heaters may be spaced around the circumference of the heating portion. The two or more electric heaters may be spaced along the length of the heating portion. Where the heating portion comprises three or more electric heaters, the three or more electric heaters may be spaced evenly across the heating portion. The three or more electric heaters may be spaced unevenly across the heating portion.

The one or more electric heaters may be any suitable shape. The one or more electric heaters may be elongate. The one or more electric heaters may extend substantially the length of the heating portion. The one or more electric heaters may be substantially annular. The one or more electric heaters may comprise one or more annular rings. The one or more rings may substantially circumscribe a portion of the outer surface of the main unit. The one or more rings may substantially circumscribe a portion of the proximal end of the heating portion. The one or more rings may substantially circumscribe a portion of the distal end of the heating portion.

The one or more electric heaters may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heater elements are disclosed in U.S. Pat. No. 5,498,855, WO-A-03/095688 and U.S. Pat. No. 5,514,630.

The distal portion of the main unit may be any suitable shape and dimensions.

The distal portion may be substantially cylindrical. The distal portion may be substantially elongate. The distal portion may have any suitable cross-section. For example, the cross-section of the distal portion may be substantially circular, elliptical, square or rectangular. The distal portion may be configured to be held by a user during use of the aerosol-generating system.

The width of the distal portion of the main unit may be larger than the width of the proximal portion of the main unit. This may provide a larger space in the distal portion than in the proximal portion and may enable the distal portion to accommodate a power supply and electric circuitry.

The width of the distal portion of the main unit may be similar to the width of the tubular aerosol-generating article. As such, when the tubular aerosol-generating article is received on the heating portion of the main unit, the aerosol-generating system may form a substantially cylindrical unit having a substantially consistent width along its length. This may enable the aerosol-generating system to resemble a conventional smoking article, such as a cigar or a cigarette.

The distal portion may have a width of between about 5 mm and about 20 mm, between about 5 mm and about 12 mm or about 8 mm. The distal portion may have a length of between about 10 mm and about 100 mm, or between about 10 mm and about 50 mm or about 45 mm.

The main unit may comprise a shoulder between the heating portion and the distal portion of the main unit. The shoulder may connect the outer surface of the proximal portion of the main unit to the outer surface of the distal portion of the main unit. The shoulder may comprise an angled, sloped or bevelled surface joining the proximal portion of the main unit and the distal portion of the main unit. The shoulder may comprise a wall extending substantially radially outwards from the outer surface of the proximal portion of the main unit to the outer surface of the distal portion of the main unit.

The proximal portion of the main unit may be configured such that the distal end of the tubular aerosol-generating article may abut or contact the shoulder when the tubular aerosol-generating article is received on the heating portion. As such, the shoulder may act as a stop to inhibit movement of the tubular aerosol-generating article beyond the heating portion in a distal direction relative to the main unit. This may facilitate positioning of the tubular aerosol-generating article on the heating portion of the main unit in the desired position along the length of the main unit.

The main unit may further comprise a distal stop. The distal stop may be arranged distal to the heating portion of the main unit. The distal stop may be configured to engage with the distal end of the tubular aerosol-generating article when the tubular aerosol-generating article is received on the heating portion. Where the main unit comprises a shoulder between the proximal portion and the distal portion, there distal stop may be arranged between the heating portion and the shoulder.

The main unit may comprise one or more electric power supplies. The one or more electric power supplies may be arranged in the distal portion of the main unit. The one or more power supplies may comprise a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The one or more power supplies may comprise other forms of charge storage devices, such as capacitors. The one or more power supplies may require recharging and may be configured for many cycles of charge and discharge. The one or more power supplies may have a capacity that allows for the storage of enough energy for one or more user experiences; for example, the one or more power supplies may have sufficient capacity to allow for the continuous generation of aerosol for a period of around six minutes, corresponding to the typical time taken to smoke a conventional cigarette, or for a period that is a multiple of six minutes. In another example, the one or more power supplies may have sufficient capacity to allow for a predetermined number of puffs or discrete activations of the heating means and actuator.

The main unit may comprise electric circuitry configured to control the supply of power to the one or more electric heaters from the one or more electrical power supplies. Where the main unit comprises two or more electric heaters, the electric circuitry may be configured to supply power to all of the electric heaters simultaneously. Where the main unit comprises two or more electric heaters, the electric circuitry may be configured to supply power to each electric heater separately. The electric circuitry may be configured to supply power to each electric heater selectively. The electric circuitry may be configured to supply power to the electric heaters sequentially. The electric circuitry may be configured to supply power to selected ones of the electric heaters in a predetermined sequence. For example, the electric circuitry may be configured to supply power to one heater per puff. In another example, the electric circuitry may be configured to supply power to a first heater for a predetermined period of time and subsequently to supply power to a second heater for a predetermined period of time. This may enable selective heating of portions of the aerosol-forming substrate. This may enable variation of the aerosol supplied to the user during a puff. This may enable portions of the aerosol-forming substrate to be heated to different temperatures. This may enable the aerosol-generating system to preserve unheated portions of aerosol-forming substrate for each puff of a user experience.

The main may comprise a user input, such as a switch or button. This may enable the user to switch the main unit on and off. The switch or button may activate the aerosol-generating means. The switch or button may initiate aerosol generation. The switch or button may prepare the electric circuitry to await input from the puff detector.

The electric circuitry may comprise a sensor or a puff detector to detect air flow through the aerosol-generating system indicative of a user taking a puff. The electric circuitry may be configured to provide supply power to the one or more electric heaters when the sensor senses a user taking a puff.

The main unit may comprise a mouthpiece. The mouthpiece may be arranged at the proximal end of the main unit. The mouthpiece may be configured to allow a user to suck, puff or draw on the mouthpiece to draw air and vapour through one or more airflow pathways of the aerosol-generating system.

The mouthpiece may comprise retaining means in accordance with the present invention. For example, the mouthpiece may comprise one or more of the one or more protrusions. In another example, the mouthpiece may comprise the second magnetic material.

The mouthpiece may be removably receivable on the main unit. Where the mouthpiece is removable from the main unit, the mouthpiece may comprise a cover arranged to overlap the tubular aerosol-generating article when the tubular aerosol-generating article is received on the heating portion of the main unit. The cover may further facilitate retention of heat around the tubular aerosol-generating article and may inhibit the exit of vapour from the tubular aerosol-generating article through the outer surface of the tubular aerosol-generating article.

According to a third aspect of the present invention, there is provided a main unit for an electrically operated aerosol-generating system according to any preceding claim, the main unit comprising: a heating portion at an outer surface of the main unit, the heating portion comprising one or more electric heaters.

The main unit may further comprise one or more air passages through the heating portion and one or more air inlets arranged at the heating portion. The main unit may further comprise a mouthpiece configured such that when a user draws on the mouthpiece, the user draws air through the one or more air passages of the main unit.

When the electrically operated aerosol-generating system is assembled for use and the tubular aerosol-generating article is received on the heating portion of the main unit, the aerosol-generating system may have a substantially cylindrical shape. The aerosol-generating system may have a total length of between about 70 mm and about 200 mm, or between about 70 mm and about 150 mm, or about 120 mm. The aerosol-generating system may have a width of between about 5 mm and about 20 mm, between about 5 mm and about 10 mm or about 8 mm.

The main unit may be configured to be durable. The main unit may be configured to be reusable.

The tubular aerosol-generating article may be configured to be a disposable component. The tubular aerosol-generating article may be configured to be disposed after a single user experience. In contrast, the main unit may be configured to be durable and reusable. The main unit may comprise relatively expensive and durable components of the aerosol-generating system, such as a power supply, heaters, and electrical circuitry.

The tubular aerosol-generating article may be manufactured, stored and sold separately from the main unit. Each tubular aerosol-generating article may be individually packaged. A plurality of the tubular aerosol-generating articles may be packaged and sold together, similarly to conventional smoking articles such as cigarettes.

The aerosol-generating system may be an electrically operated smoking system. The overall dimensions of the aerosol-generating system may be similar to a conventional smoking article such as a cigarette, a cigar a cigarillo or any other such smoking article.

Embodiments in accordance with the present invention will now be described in detail, by way of example only, with reference to the accompanying drawings, in which.

Figure 1:
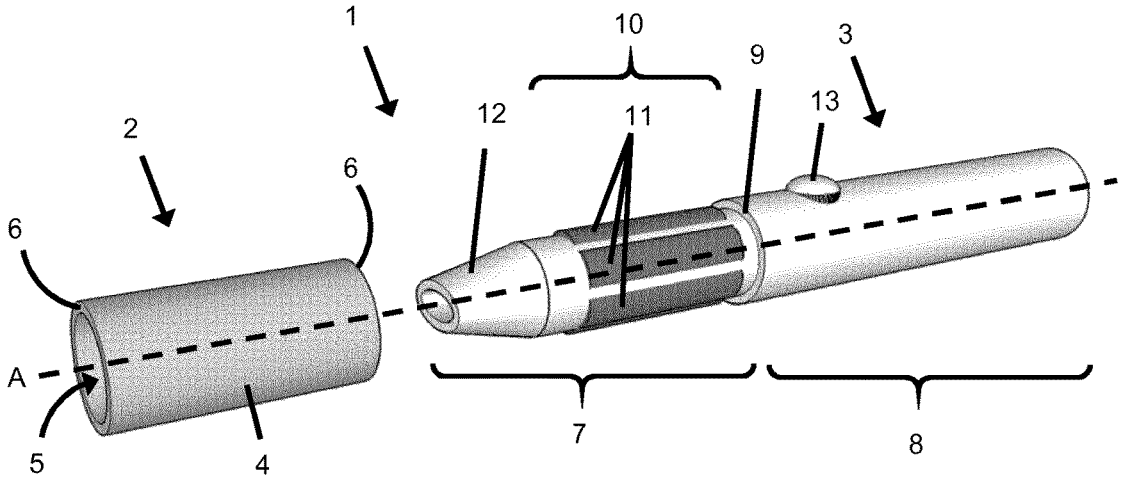
FIG. 1 is a schematic illustration of an electrically operated aerosol-generating system according to a first embodiment of the present invention.
Figure 2:
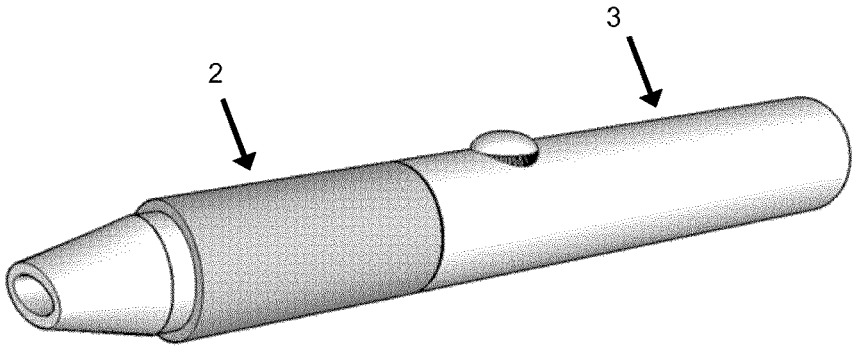
FIG. 2 is a schematic illustration of the electrically operated aerosol-generating system of FIG. 1, showing the tubular aerosol-generating article fully received on the main unit.
Figure 3:
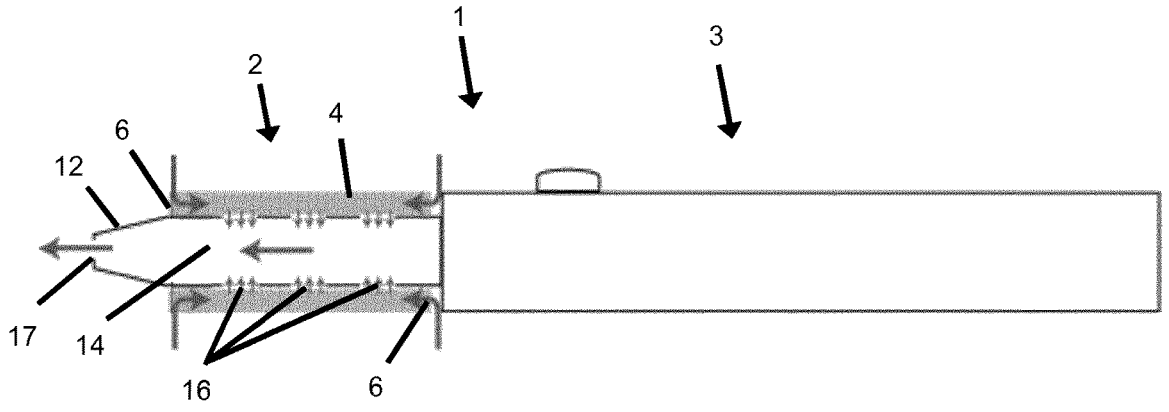
FIG. 3 is a schematic illustration of the electrically operated aerosol-generating system of FIG. 1 showing airflow through the aerosol-generating system when the tubular aerosol-generating article is fully received on the main unit and a user is drawing on the mouthpiece.

An electrically operated aerosol-generating system according to a first aspect of the present invention is shown in FIGS. 1 to 3. The electrically operated aerosol-generating system 1 comprises a tubular aerosol-generating article 2 and a main unit 3.

The tubular aerosol-generating article 2 comprises a cylindrical open-ended hollow tube of aerosol-forming substrate 4. An inner passage 5 extends centrally through the tubular aerosol-forming substrate 4 and extends the length of the tubular aerosol-forming substrate 4 such that both ends of the inner passage 5 are open. Both open ends of the inner passage 5 are configured to receive a proximal portion 7 of the main unit 3.

The tubular body of aerosol-forming substrate 4 comprises one or more gathered sheets of tobacco circumscribed by an outer wrapper (not shown), which covers the cylindrical outer surface of the tubular body of aerosol-forming substrate 4. The outer wrapper is formed of a material that is substantially impermeable to gas, such that the outer wrapper substantially prevents ambient air from being drawn into the tubular aerosol-generating article 2 through the cylindrical outer surface. The outer wrapper also substantially prevent vapour from the heated aerosol-forming substrate 4 from leaving the tubular aerosol-generating article 2 via the cylindrical outer surface.

The outer wrapper does not extend over the annular end faces 6 of the tubular aerosol-forming substrate 4, such that the annular end faces 6 of the tubular aerosol-forming substrate 4 are exposed to ambient air. Ambient air may be drawn into the tubular aerosol-generating article 2 through either annular end face 6. Similarly, the open ends of the inner passage 5 are not covered by the outer wrapper, such that the proximal portion 7 of the main unit 3 may be inserted into either end of the inner passage 5.

The main unit 3 comprises a substantially circularly-cylindrical hollow housing formed of a rigid, thermally insulating material, such as PEEK. The main unit 3 comprises a proximal portion 7 and a distal portion 8 that are separated by a shoulder 9.

The proximal portion 7 comprises a heating portion 10. The heating portion 10 extends over a portion of the outer surface of the proximal portion 7. The heating portion 10 comprises seven identical electrical heaters 11. The seven electric heaters 11 are spaced evenly around the circumference of the heating portion 10. Each of the electrical heaters 11 is elongate and arranged with its length extending in the direction along a longitudinal axis A of the main unit 3. The length of each electric heater 11 is substantially similar to the length of the tubular aerosol-generating article 2. As such, when the tubular aerosol-generating article 2 is received on the heating portion 10 of the main unit 3, the tubular aerosol-generating article 2 overlaps and covers the electrical heaters 11 along their entire length. This enables a substantial proportion of the heat produced by the heaters 11 to be transferred to the aerosol-forming-substrate 4 rather than to ambient air during use of the aerosol-generating system.

The heating portion 10 of the main unit 3 has a circularly-cylindrical cross-section that is substantially similar to the cross-section of the inner passage 5 of the tubular aerosol-generating article 2. The width of the heating portion 10 is slightly larger than the width of the inner passage 5. As such, the heating portion 10 of the main unit 3 may be inserted into the inner passage 5 of the tubular aerosol-generating article with an interference or a friction fit. The interference or friction fit ensures contact between the electric heaters 11 at the outer surface of the heating portion 10 of the main unit 3 and the inner surface of the inner passage 5 of the tubular aerosol-generating article 2, when the tubular aerosol-generating article 2 is received on the heating portion 10. This contact facilitates heat transfer between the heaters 11 and the tubular aerosol-forming substrate 4. The interference of friction fit also provides some resistance against movement of the tubular aerosol-generating article 2 along the longitudinal axis A of the main unit 3. As such, the interference or friction fit helps to retain the tubular aerosol-generating article 2 on the heating portion 10 of the main unit 3.

The proximal portion 7 of the main unit 3 further comprises a tapered mouthpiece 12 at the proximal end of the main unit 3 for a user to draw upon to receive aerosol generating by the aerosol-generating system.

The distal portion 8 of the main unit 3 has a cylindrical cross-section that is substantially similar to the cylindrical cross-section of the tubular aerosol-generating article 2. The width of the distal portion 8 is substantially similar to the width of the tubular aerosol-generating article 2. As such, when the tubular aerosol-generating article 2 is received on the heating portion 10 of the main unit 3, the electrically operated aerosol-generating system 1 forms a substantially circularly-cylindrical unit having a consistent width or diameter that may resemble a conventional cigarette or cigar, as shown in FIG. 2.

The distal portion 8 of the main unit 2 houses a battery (not shown) and electric circuitry (not shown) inside the hollow housing. The battery is arranged and configured to supply power to the electric heaters 11 of the heating portion 10. The electric circuitry is configured to control the supply of power from the battery to the electric heaters 11. The electric circuitry comprises a sensor for detecting a user's puff on the mouthpiece 12.

The electric circuitry is configured to supply power to the electric heaters 11 either simultaneously or individually in a predetermined sequence. In other words, the electric circuitry is configured to supply power to the electric heaters 11 in different heating modes, such as a simultaneous heating mode and a sequential heating mode. For example, in a simultaneous heating mode, the electric circuitry is configured to supply power to all of the heaters 11 when a puff is detected. In another example, in a sequential mode, the electric circuitry is configured to supply electrical power to a first one of the heaters 11 when a first puff is detected, to supply electrical power a second one of the heaters 11 when a second puff is detected and to subsequently supply power to individual ones of the remaining heaters 11, in sequence, for each detected puff until all of the heaters have been activated.

A push button 13 is also provided on the distal portion 8 of the main unit 3. The electric circuitry is configured to switch between heating modes on depression of the push button 13. Consecutive depressions of the push button 13 switch the heating mode of the electric circuitry between a sequential heating mode, a simultaneous heating mode and a no power mode (off).

The width of the distal portion 8 of the main unit 3 is larger than the width of the proximal portion 7. As such, the main unit 3 comprises a shoulder 9 separating the proximal portion 7 from the distal portion 8. The shoulder 9 comprises a wall extending substantially radially outwardly from the distal end of the proximal portion 7 to the proximal end of the distal portion 8.

A distal stop (not shown) is arranged on the proximal portion 7 of the main unit 3, between the heating portion 10 and the shoulder 9. The distal stop is configured to engage with the distal end of the tubular aerosol-generating article 2 when the tubular aerosol-generating article 2 is fully received on the heating portion 10. The distal stop substantially prevents movement of the tubular aerosol-generating article 2 beyond the heating portion 10 in a distal direction towards the distal portion 8.

It will be appreciated that in some embodiments, the shoulder 9 may act as the distal stop for the tubular aerosol-generating article 2. In these embodiments, the shoulder 9 may abut or contact the distal end of the tubular aerosol-generating article 2 when the tubular aerosol-generating article 2 is fully received on the heating portion 10.

As shown in FIG. 3, an air passage 14 extends through the proximal portion 7 of the main unit 3. A plurality of air inlets 16 are arranged in the outer face of the heating portion 10, between the electric heaters 11, and an air outlet 17 is provided in the mouthpiece 12. The plurality of air inlets 16 and the air outlet 17 are fluidly connected to the air passage 14 to enable air to be drawn through the air passage 14 when a user draws on the mouthpiece 12.

To assemble the electrically operated aerosol-generating system 1 for use, a user aligns main unit 3 and the inner passage of the tubular aerosol-generating article 2 along a common longitudinal axis A, with either end of the tubular aerosol-generating article 2 facing the proximal end of the main unit 3. The user moves the tubular aerosol-generating article 2 along the common axis A towards the main unit 3, such that the proximal end of the main unit 3 is inserted into the distal open end of the inner passage 5. The user slides the tubular aerosol-generating article 2 over the proximal portion 7 of the main unit 3, towards the distal portion 8, until the distal end of the tubular aerosol-generating article 2 abuts the distal stop (not shown). In this position, the tubular aerosol-generating article 2 is fully received on the heating portion 10 of the main unit 3, and the tubular aerosol-generating article 2 covers the electric heaters 11 and the air inlets 16, as shown in FIGS. 2 and 3.

In use, the user depresses the push button 13 to switch the main unit 3 from the off mode into the sequential heating mode. The user draws on the mouthpiece 12 of the main unit 3, and the electric circuitry (not shown) detects the user's puff on the mouthpiece 12. On detection of the user's puff, the electric circuitry supplies power from the power supply (not shown) to one of the electric heaters 11. The powered electric heater 11 heats a portion of the tubular aerosol-forming substrate 4 of the tubular aerosol-generating article 2. As the portion of the aerosol-forming substrate 4 is heated, volatile compounds of the aerosol-forming substrate vapourise and generating a vapour.

When the user draws on the mouthpiece 12 of the main unit 3, ambient air is drawn into the tubular aerosol-generating article 2 through the annular end faces 6 of the tubular aerosol-forming substrate 4. The air drawn into the tubular aerosol-generating article 2 is drawn through the tubular aerosol-forming substrate 4 towards the air inlets 16 of the main unit 3. The vapour generated by the heated aerosol-forming substrate is entrained in the air that is drawn through the aerosol-forming substrate 4. The entrained vapour is drawn out of the tubular aerosol-forming substrate 4 at the inner face of the inner passage 5 and enters the air passage 14 of the main unit 3 through the air inlets 16. The entrained vapour is drawn through the air passage 14 in a proximal direction towards the mouthpiece 12. As the vapour is drawn through the air passage 14, the vapour cools and forms an aerosol. The aerosol is drawn out of the air passage 14 through the air outlet 17 in the mouthpiece 12, and is delivered to the user for inhalation. The direction of airflow through the system 1 is indicated by the arrows shown in FIG. 3.

It will be appreciated that in some examples the tubular aerosol-generating article may comprise one or more air inlets at the cylindrical outer face, in the form of one or more perforations in the outer layers or wrappers circumscribing the tubular aerosol-forming substrate. In these embodiments, air may be drawn into the tubular aerosol-generating article through the perforations in the cylindrical outer face. The main unit may also comprise additional air inlets arranged distal or proximal to the heating portion. These additional air inlets may not be covered by the tubular aerosol-generating article when the tubular aerosol-generating article is fully received on the heating portion of the main unit. As such, these additional air inlets may enable ambient air to be drawn directly into the air passage of the main unit and may help to cool the vapour and aerosol before inhalation by the user. This may improve the experience for the user.

Figure 4:
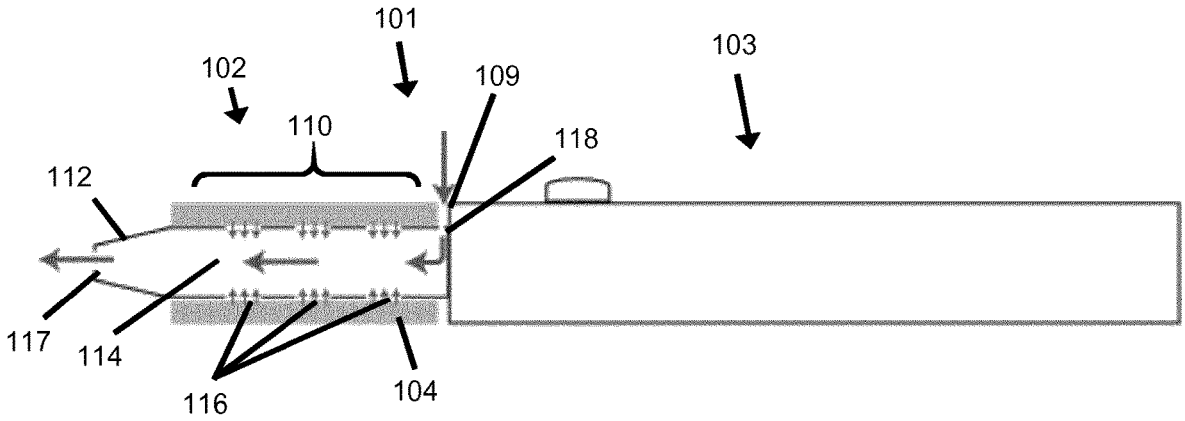
FIG. 4 is a schematic illustration of an electrically operated aerosol-generating system according to a second embodiment of the present invention.

FIG. 4 shows an electrically operated aerosol-generating system 101 according to a second embodiment of the present invention. The electrically operated aerosol-generating system 101 comprises a tubular aerosol-generating article 102 and a main unit 103. The tubular aerosol-generating article 102 and the main unit 103 are substantially similar to the tubular aerosol-generating article 2 and the main unit 3 described above in relation to FIGS. 1 to 3, and where the same features are present like reference numerals have been used to refer to these features.

The main unit 103 comprises an additional air inlet 118 in the outer surface of the proximal portion, between the heating portion 110 and the shoulder 109. The additional air inlet 118 enables ambient air to be drawn directly into the air passage 114 of the main unit 103 when a user draws on the mouthpiece 112. The ambient air drawn directly into the air passage 114 may mix with the vapour from the heated aerosol-forming substrate 104 drawn into the air passage 114 through the air inlets 116 and facilitates cooling of the vapour before it is drawn out of the air passage 114 at the air outlet 117.

Figure 5:
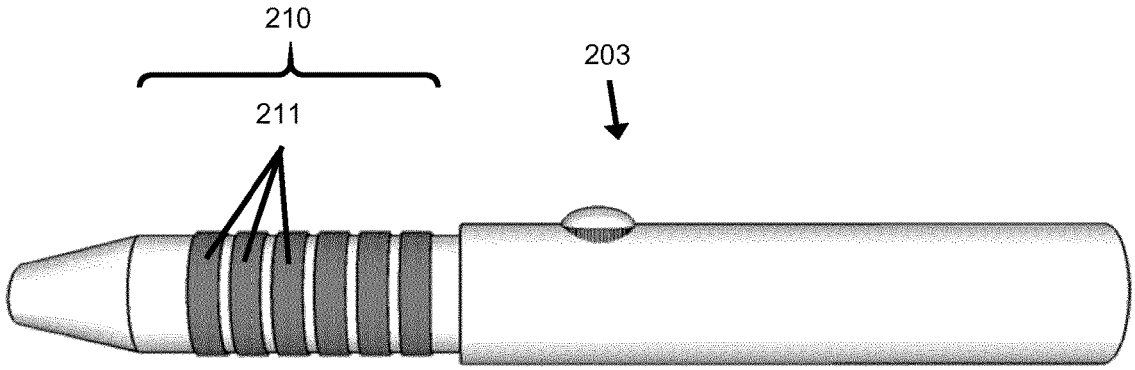
FIG. 5 is a schematic illustration of a main unit for an electrically operated aerosol-generating system according to a third aspect of the present invention.

FIG. 5 shows a main unit 203 for an electrically operated aerosol-generating system according to a third embodiment of the present invention. The main unit 203 is substantially similar to the main unit 3 described above in relation to FIGS. 1 to 3, and where the same features are present like reference numerals have been used to refer to these features.

The main unit 203 comprises six annular electrical heaters 211 circumscribing the outer surface of the heating portion 210. The six annular electric heaters 211 form rings around the outer surface of the heating portion 210 and are spaced at equal intervals along the length of the heating portion 210. The length of the heating portion 210 is substantially similar to the length of the heating portion 10 of the main unit 3 described above in relation to FIGS. 1 to 3.

Figure 6:
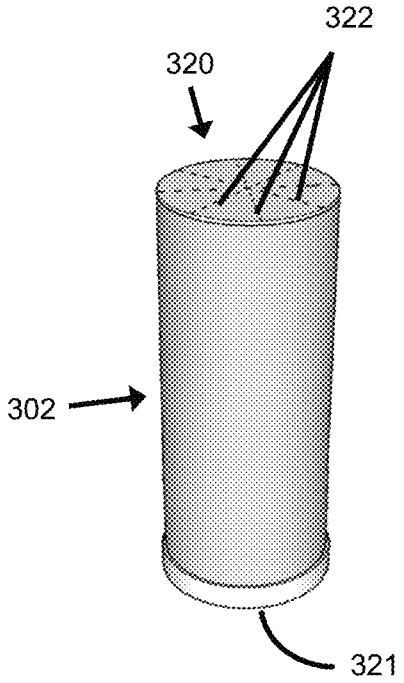
FIG. 6 is a schematic illustration of a tubular aerosol-generating article for an electrically operated aerosol-generating system according to a fourth aspect of the present invention.
Figure 7:
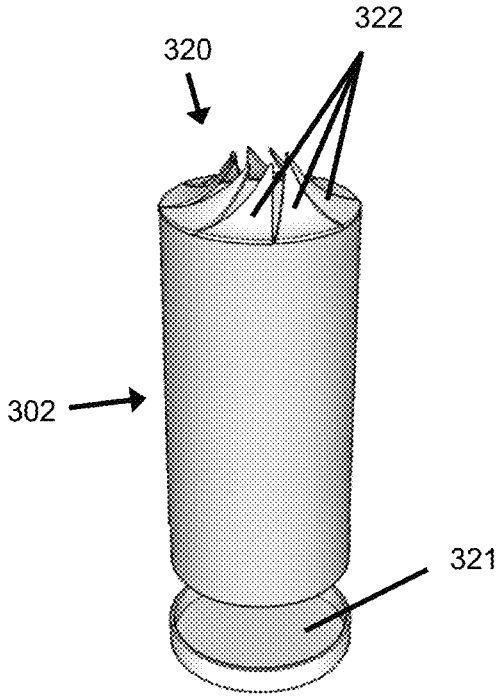
FIG. 7 is a schematic illustration of the tubular aerosol-generating article of FIG. 6.
Figure 8:
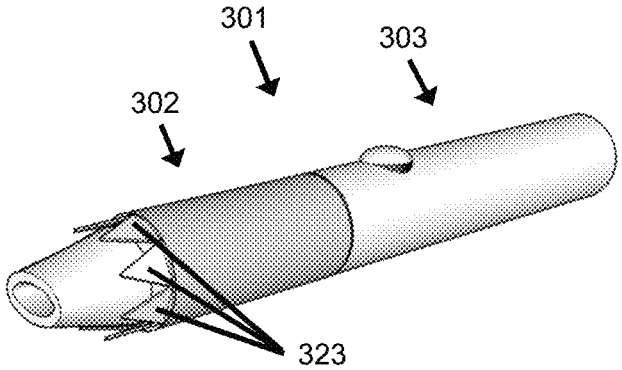
FIG. 8 is a schematic illustration of the tubular aerosol-generating article of FIG. 6 received on a main unit.

FIGS. 6 to 8 show an electrically operated aerosol-generating system 301 according to a fourth embodiment of the present invention. The electrically operated aerosol-generating system 301 comprises a tubular aerosol-generating article 302 and a main unit 303. The tubular aerosol-generating article 302 and the main unit 303 are substantially similar to the tubular aerosol-generating article 2 and the main unit 3 described above in relation to FIGS. 1 to 3, and where the same features are present like reference numerals have been used to refer to these features.

The tubular aerosol-generating article 302 further comprises a penetrable cover 320 overlying a proximal end of the article 302 and an end cap 321 overlying the opposite, distal end of the article 302.

The penetrable cover 320 is formed of a laminate material comprised of aluminium and plastic film and is secured to the proximal end of the article 302 by an adhesive layer (not shown). The penetrable cover 320 comprises four frangible sections, in the form of score lines 322 extending across the width of the cover 320. The score lines 322 cross at the middle, such that the penetrable cover 320 is divided into eight equal wedges.

The cap 321 is formed of a rigid plastic material, and comprises a cavity configured to removably receive the distal end of the aerosol-generating article 302.

Figure 9:
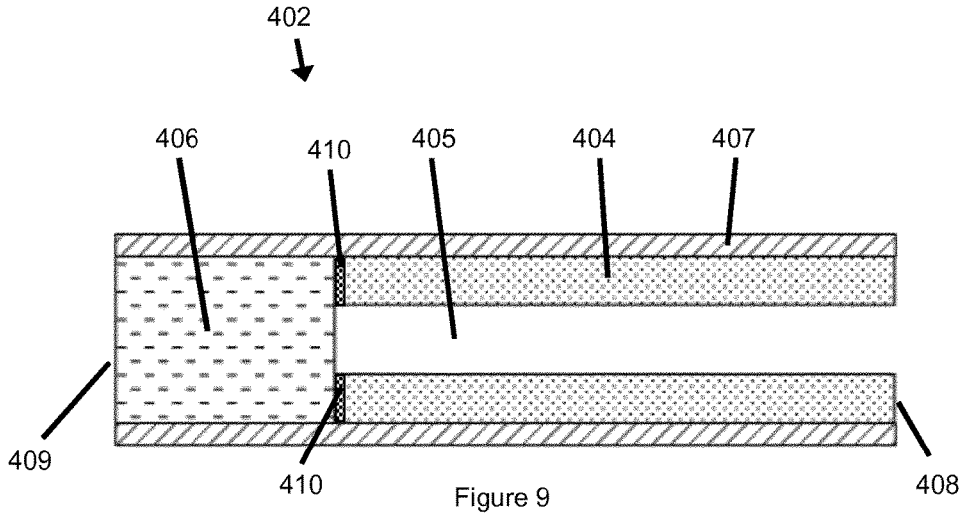
FIG. 9 is a schematic illustration of a tubular aerosol-generating article for an electrically operated aerosol-generating system according to a fifth aspect of the present invention.

To assemble the system 301 for use, a user removes the cap 321 from the distal end of the article 302 and inserts the proximal end of the main unit 303 into the open distal end of the inner passage of the article 302. The user slides the main unit through the inner passage of the article 302 until the proximal end of the main unit contacts the penetrable cover 320. The user applies a moderate force on the main unit 303 against the penetrable cover 320, which breaks the score lines 322 and enables the article 302 to be pushed further onto the proximal end of the main unit 203. The wedges of the broken penetrable cover 320 remain attached to the tubular aerosol-generating article and form a partial seal over the proximal end of the main unit 303 when the article 302 is fully received on the heating portion of the main unit 302, as shown in FIG. 9. The partial seal may inhibit the release of vapour from the heated tubular aerosol-forming substrate out of the proximal end of the tubular aerosol-generating article 302.

Figure 10:
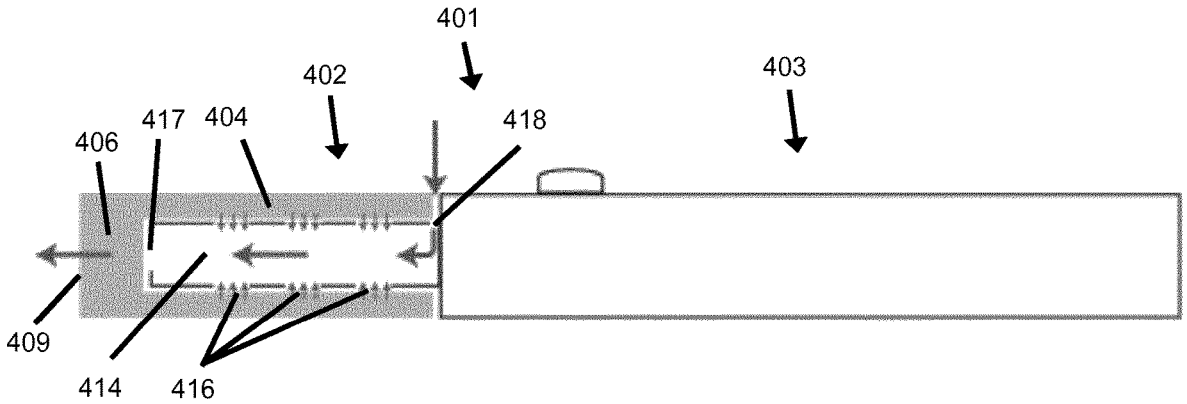
FIG. 10 is a schematic illustration of the tubular aerosol-generating article of FIG. 9 received on a main unit.

FIGS. 9 and 10 show an electrically operated aerosol-generating system 401 according to a fifth embodiment of the present invention. The electrically operated aerosol-generating system 401 comprises a tubular aerosol-generating article 402 and a main unit 403.

The tubular aerosol-generating article 402 comprises a cylindrical open-ended hollow tube of aerosol-forming substrate 404. An inner passage 405 extends centrally through the tubular aerosol-forming substrate 404 and extends the length of the tubular aerosol-forming substrate 404 such that both ends of the inner passage 405 are open.

The tubular aerosol-generating article 402 further comprises a mouthpiece 406. The mouthpiece 406 comprises a circularly-cylindrical body of cellulose acetate, having a substantially similar circular cross-section and width to the tubular aerosol-forming substrate 404. The tubular aerosol-forming substrate 404 and the mouthpiece 406 are arranged in abutting coaxial alignment, such that the tubular aerosol-forming substrate 404 and mouthpiece 406 are configured to form a rod. The proximal end of the tubular aerosol-forming substrate 404 abuts the distal end of a mouthpiece 406.

The tubular aerosol-forming substrate 404 and the mouthpiece 406 are circumscribed by an outer wrapper 407. The outer wrapper 407 secures the tubular aerosol-forming substrate 404 to the mouthpiece 406. The outer wrapper 407 is formed of a material that is substantially impermeable to gas, such that the outer wrapper 407 substantially prevents ambient air from being drawn into the tubular aerosol-generating article 402 through the cylindrical outer surface. The outer wrapper 407 covers the cylindrical outer surfaces of the tubular aerosol-forming substrate 404 and the mouthpiece 406, but does not extend over the end faces, such that air may be drawn through the tubular aerosol-generating article 402, from the distal end face 408 to the proximal end face 409. A substantially air impermeable barrier 410 is arranged between the proximal end of the tubular aerosol-forming substrate 404 and the distal end of the mouthpiece 406. The substantially air impermeable barrier 410 comprises an annular layer of substantially air impermeable material. The substantially air impermeable barrier prevents air from being drawn directly between the tubular aerosol-forming substrate 404 and the mouthpiece 406.

The distal end of the inner passage 405 is open and is configured to receive a proximal portion of the main unit 403. The proximal end of the inner passage 405 is arranged at the distal end of the mouthpiece 406.

The main unit 403 is substantially similar to the main unit 103 described above in relation to the example shown in FIGS. 4 and 5. However, the main unit 403 does not comprise a mouthpiece. The heaters (not shown) of the main unit 403 extend to the proximal end of the main unit 403, such that the proximal end of the main unit is the proximal end of the heating portion. The main unit 403 comprises an air outlet 417 at the proximal end of the heating portion.

The main unit 403 comprises a distal stop (not shown) arranged between the distal end of the heating portion and the shoulder of the main unit 403. However, it will be appreciated that the distal stop may not be required as the proximal end of the main unit may abut the distal end of the mouthpiece 406 when the tubular aerosol-generating article 402 is fully received on the heating portion.

To assemble the electrically operated aerosol-generating system 401 for use, a user aligns the main unit 403 and the inner passage 405 of the tubular aerosol-generating article 402 along a common longitudinal axis, with the distal end 408 of the tubular aerosol-generating article 402 facing the proximal end of the main unit 403. The user moves the tubular aerosol-generating article 402 along the common axis towards the main unit 403, such that the proximal end of the main unit 403 is inserted into the open distal end of the inner passage 405. The user slides the tubular aerosol-generating article 402 over the proximal portion of the main unit 403, in a distal direction towards the distal portion, until the distal end 408 of the tubular aerosol-generating article 402 abuts the distal stop and the proximal end of the main unit 403 abuts the distal end of the mouthpiece 406. In this position, the tubular aerosol-generating article 402 is fully received on the heating portion of the main unit 403, and the tubular aerosol-generating article 402 covers the electric heaters, as shown in FIG. 10.

In use, the user depresses the push button to switch the main unit 403 from the off mode into the sequential heating mode. The user draws on the mouthpiece 406 of the tubular aerosol-generating article 402, and the electric circuitry (not shown) of the main unit 403 detects the user's puff on the mouthpiece 406. On detection of the user's puff, the electric circuitry supplies power from the power supply (not shown) to one of the electric heaters. The powered electric heater heats a portion of the tubular aerosol-forming substrate 404 of the tubular aerosol-generating article 402. As the portion of the aerosol-forming substrate 404 is heated, volatile compounds of the aerosol-forming substrate vapourise and generating a vapour.

When the user draws on the mouthpiece 406 of the tubular aerosol-generating article, ambient air is drawn into the tubular aerosol-generating article 402 through the distal annular end face of the tubular aerosol-forming substrate 404. The air drawn into the tubular aerosol-generating article 402 is drawn through the tubular aerosol-forming substrate 404 towards the air inlets 416 of the main unit 403. The vapour generated by the heated aerosol-forming substrate is entrained in the air that is drawn through the aerosol-forming substrate 404. The entrained vapour is drawn out of the tubular aerosol-forming substrate 404 at the inner face of the inner passage 405 and enters the air passage 414 of the main unit 413 through the air inlets 416. The entrained vapour is drawn through the air passage 414 in a proximal direction towards the air outlet 417. As the vapour is drawn through the air passage 414, the vapour cools and forms an aerosol. Ambient air is also drawn directly into the air passage 414 of the main unit 403 through the additional air inlet 418. The ambient air mixes with the vapour and aerosol and facilitates cooling of the vapour and aerosol. The aerosol is drawn out of the air passage 414 through the air outlet 417 at the proximal end of the main unit 403 and is drawn into the mouthpiece 406. The aerosol is drawn through the mouthpiece 406, out of the proximal end 409, and is delivered to the user for inhalation. The direction of airflow through the system 401 is indicated by the arrows shown in FIG. 10.

It will be appreciated that in some embodiments, the main unit may not comprise the additional air inlets.

Figure 11:
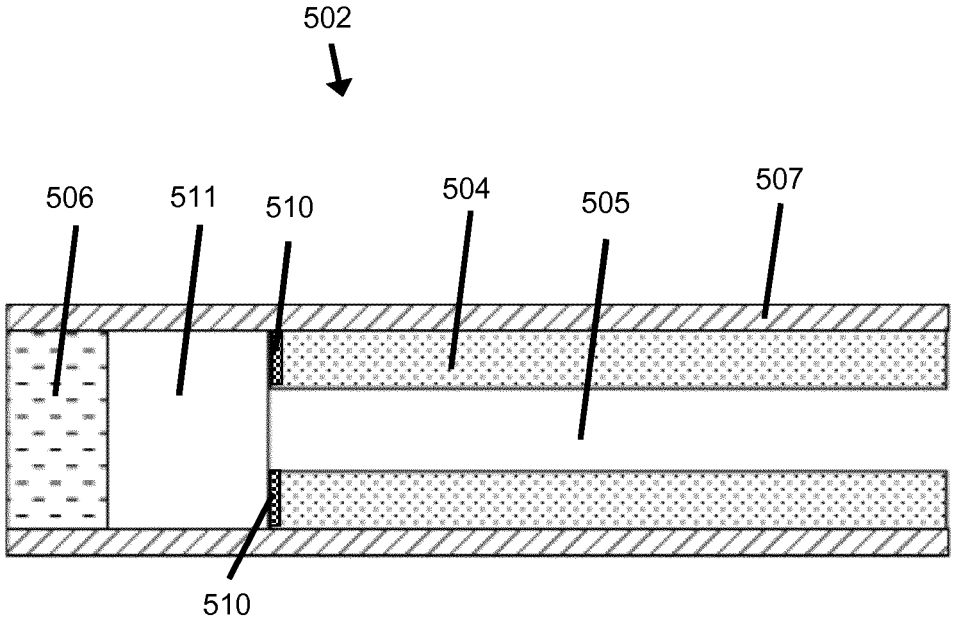
FIG. 11 is a schematic illustration of a tubular aerosol-generating article for an electrically operated aerosol-generating system according to a sixth aspect of the present invention.

FIG. 11 shows a tubular aerosol-generating article 502 for an electrically operated aerosol-generating system according to a seventh embodiment of the present invention. The tubular aerosol-generating article 502 is substantially similar to the tubular aerosol-generating article 502 described above in relation to FIGS. 9 and 10, and where the same features are present like reference numerals have been used to refer to these features.

The tubular aerosol-generating article 502 comprises a cylindrical open-ended hollow tube of aerosol-forming substrate 504. An inner passage 505 extends centrally through the tubular aerosol-forming substrate 504 and extends the length of the tubular aerosol-forming substrate 504 such that both ends of the inner passage 505 are open.

The tubular aerosol-generating article 502 further comprises a mouthpiece 506. The mouthpiece 506 comprises a circularly-cylindrical body of cellulose acetate, having a substantially similar circular cross-section and width to the tubular aerosol-forming substrate 504.

The tubular aerosol-generating article 502 further comprises a cooling element 511 arranged between the tubular aerosol-forming substrate 504 and the mouthpiece 506. The cooling element 511 comprises a substantially cylindrical body formed of a gathered sheet of substantially non-porous paper.

The tubular aerosol-forming substrate 504, the cooling element 511 and the mouthpiece 506 are arranged in abutting coaxial alignment, such that the tubular aerosol-forming substrate 504, the cooling element 511 and the mouthpiece 506 form a rod. The proximal end of the tubular aerosol-forming substrate 504 abuts the distal end of the cooling element 511 and the proximal end of the cooling element 511 abuts the distal end of the mouthpiece 506.

The tubular aerosol-forming substrate 504, the cooling element 511 and the mouthpiece 506 are circumscribed by an outer wrapper 507. The outer wrapper 507 secures the tubular aerosol-forming substrate 504, the cooling element 511 and the mouthpiece 506 together.

A substantially air impermeable barrier 510 is arranged between the proximal end of the tubular aerosol-forming substrate 504 and the distal end of the cooling element 511. The substantially air impermeable barrier 510 comprises an annular layer of substantially air impermeable material. The substantially air impermeable barrier prevents air from being drawn directly between the tubular aerosol-forming substrate 504 and the cooling element 511.

It will be appreciated that the examples described herein are straightforward examples, and that modifications may be made to the illustrated circuits to provide different or more sophisticated functionality. It will be appreciated that features described herein with reference to one embodiment may be applied to other embodiments without departing from the scope of the invention.

The invention claimed is:

1. An electrically operated aerosol-generating system, comprising:

a main unit comprising a heating portion disposed at an outer surface of the main unit, the heating portion comprising one or more air inlets and two or more electric heaters spaced over the heating portion, the one or more air inlets being arranged in spaces between the two or more electric heaters;

a tubular aerosol-generating article comprising:

a tubular aerosol-forming substrate, and an inner passage, wherein:

the inner passage of the tubular aerosol-generating article is configured to receive the heating portion of the main unit, and the two or more electric heaters are arranged to heat the tubular aerosol-forming substrate when the tubular aerosol-generating article is received on the heating portion of the main unit; and one or more airflow pathways configured such that air may be drawn along the one or more airflow pathways through the aerosol-generating system, the one or more airflow pathways comprising one or more air passages though the heating portion of the main unit.

2. The electrically operated aerosol-generating system according to claim 1, wherein the heating portion has a circumference and the two or more electric heaters are spaced around the circumference of the heating portion.

3. The electrically operated aerosol-generating system according to claim 2, wherein the heating portion has a length and the two or more electric heaters are spaced along the length of the heating portion.

4. The electrically operated aerosol-generating system according to claim 1, wherein the main unit further comprises one or more air outlets, and the one or more air passages of the main unit extend through the heating portion of the main unit between the one or more air inlets and the one or more air outlets.

5. The electrically operated aerosol-generating system according to claim 4, further comprising a mouthpiece, the mouthpiece being configured such that when a user draws on the mouthpiece the user draws air through the one or more air passages of the main unit.

6. The electrically operated aerosol-generating system according to claim 5, wherein the main unit further comprises the mouthpiece and the mouthpiece comprises the one or more air outlets.

7. The electrically operated aerosol-generating system according to claim 5, wherein the tubular aerosol-generating article further comprises the mouthpiece and the one or more air outlets of the main unit are directed towards the mouthpiece when the tubular aerosol-generating article is received on the heating portion of the main unit.

8. The electrically operated aerosol-generating system according to claim 5, wherein the tubular aerosol-generating article further comprises a substantially air-impermeable barrier disposed between the tubular aerosol-forming substrate and the mouthpiece.

9. The electrically operated aerosol-generating system according to claim 1, wherein the main unit further comprises one or more additional air inlets arranged adjacent to the heating portion.

10. A main unit for an electrically operated aerosol-generating system according to claim 1, the main unit comprising a heating portion arranged at an outer surface of the main unit, the heating portion comprising one or more electric heaters.

11. The main unit according to claim 10, wherein the main unit further comprises one or more air passages though the heating portion, and the heating portion comprises one or more air inlets.

* * * * *